United States Patent [19]

Meacham

[11] 4,158,321

[45] Jun. 19, 1979

[54] CASING FEEDER FOR A SHELL RELOADER

[76] Inventor: Robert L. Meacham, 472 N. Oakhill Ave., Janesville, Wis. 53545

[21] Appl. No.: 819,156

[22] Filed: Jul. 26, 1977

[51] Int. Cl.[2] ..... F42B 33/10

[52] U.S. Cl. ..... 86/45; 86/23; 221/171

[58] Field of Search ..... 86/23–46; 221/171, 173; 224/13, 14, 15, 16

[56] References Cited

U.S. PATENT DOCUMENTS

| | | | |
|---|---|---|---|
| 944,364 | 12/1909 | Hodge | 86/45 |
| 3,153,977 | 10/1964 | Dicken | 86/45X |
| 3,320,848 | 5/1967 | Ponsness | 86/38 |

FOREIGN PATENT DOCUMENTS

| | | | |
|---|---|---|---|
| 718824 | 1/1932 | France | 86/46 |
| 328849 | 8/1935 | Italy | 221/171 |
| 10204 of | 1908 | United Kingdom | 86/46 |
| 20286 of | 1912 | United Kingdom | 86/45 |

*Primary Examiner*—Harold J. Tudor
*Attorney, Agent, or Firm*—Harry C. Engstrom; Theodore J. Long; Nicholas J. Seay

[57] ABSTRACT

A casing feeder device which attaches to and is adapted for use with a shell reloading machine. A casing hopper is mounted on the top of an upright loading tube and has a discharge opening through which casings fall by gravity rim end downwardly to the receiver portion of the reloading machine. An adjustable tube support collar loosely surrounds and supports the loading tube in an upright position, and is attached to a reciprocating link on the reloading machine to provide agitation to the hopper as the link is moved, causing migration of casings within the hopper to the discharge opening.

5 Claims, 3 Drawing Figures

CASING FEEDER FOR A SHELL RELOADER

BACKGROUND OF THE INVENTION

This invention pertains generally to the field of shell reloading machines and more particularly to devices for feeding empty casings to the reloading machine.

Because of the cost of shell casings, it is cheaper to reload the casings with powder and bullets than to purchase new shells. An example of a commonly used shell reloading machine is shown in U.S. Pat. No. 2,031,850. In this machine, the spent shell casings are delivered to a rotating table on which the reloading operations are performed in sequential steps as a manual operating lever is actuated.

While the above described machine, and others like it, greatly speed up the reloading operation, they all require that the shell casings provided to the machine be aligned such that the rim end of each casing is disposed in the same direction. A stack of aligned casings is usually supported in a hollow tube which delivers the casings to the casing receiver and feeder on the reloading machine. However, casings must be pre-stacked in the tube by hand or the operator of the machine must manually insert the shell casings one by one into the loading tube with the rim end downward, an operation which is time consuming and disruptive of the normal flow of work being performed by the reloading machine.

SUMMARY OF THE INVENTION

The casing feeding device of my invention is especially adapted to provide shell casings in aligned relation to the casing receiver portion of a standard manually operated shell reloading machine. My device greatly simplifies the loading the shells and saves the time of the operator, and performs its function faithfully without complicated mechanisms or moving parts.

The common manual shell reloading machine has a casing receiver which is adapted to receive shell casings rim end downward, with the shell casings then being individually pushed onto a rotating working table on which the loading operations are performed. A loading tube supports a stack of shell casings which drop by gravity into the casing receiver. My device provides the proper rim end downward alignment of shell casings which are dropped into the casing receiver.

The case feeding device includes a casing hopper which is removably mounted on top of the loading tube by a depending sleeve and support cone. A circular discharge opening in the bottom of the hopper is aligned and in communication with the bore of the loading tube so that the tube receives casings which fall by gravity through the opening. Because all common shell casings are substantially heavier at the rim end than at the open end, the center of gravity of a casing will be very close to its rim. For an opening of slightly larger diameter than the casing rim, the center of gravity of the casing will always be supported by the bottom of the hopper when the open end of the casing extends over the edge of the opening. However, only a slight extension of the casing rim over the edge of the opening is required before the casing center of gravity extends over the edge, with the result that the casing tips into the opening.

The effective size of the discharge opening can be expanded by rounding or beveling the edges of the opening. The curvature of the edge of the opening increases the probability that the rim end of the casing will roll or slip into the opening, but does not substantially increase the likelihood that the open end of the casings will tip into the opening.

The casing hopper is formed with curved sides and a substantially flat bottom portion, with the discharge opening being located centrally within the bottom portion of the hopper. The dished sides of the hopper tend to center the casings.

The shell loading tube and the casing hopper mounted thereon are maintained in an upright position by a tube support collar which loosely surrounds and slidably engages the tube at a position toward the upper end thereof, with the support collar itself being mounted to one of the reciprocating links of the shell reloader. As the handle of the shell reloader is operated to move the reciprocating link upward and downward and pivotally, the tube support collar will move up and down on the tube without lifting the tube out of the casing receiver and will also reciprocate slightly back and forth. This back and forth motion shakes the casings within the hopper and causes them to migrate within the hopper toward the central discharge opening. The rotational position of the collar is adjustable around a horizontal axis, and the collar is also adjustable axially in and out.

As indicated above, my casing feeder has no moving parts, utilizing only the motion provided by the reciprocating link as the shell reloader is operated. Nonetheless, casings are delivered rim end downwardly into the shell loading tube with extremely high reliability.

Further objects, features, and advantages of my invention will be apparent from the following detailed description taken in conjunction with the accompanying drawings showing a preferred embodiment of a casing feeding device for a shell reloader exemplifying the principles of my invention.

DESCRIPTION OF THE PREFERRED EMBODIMENT

Figure 1:
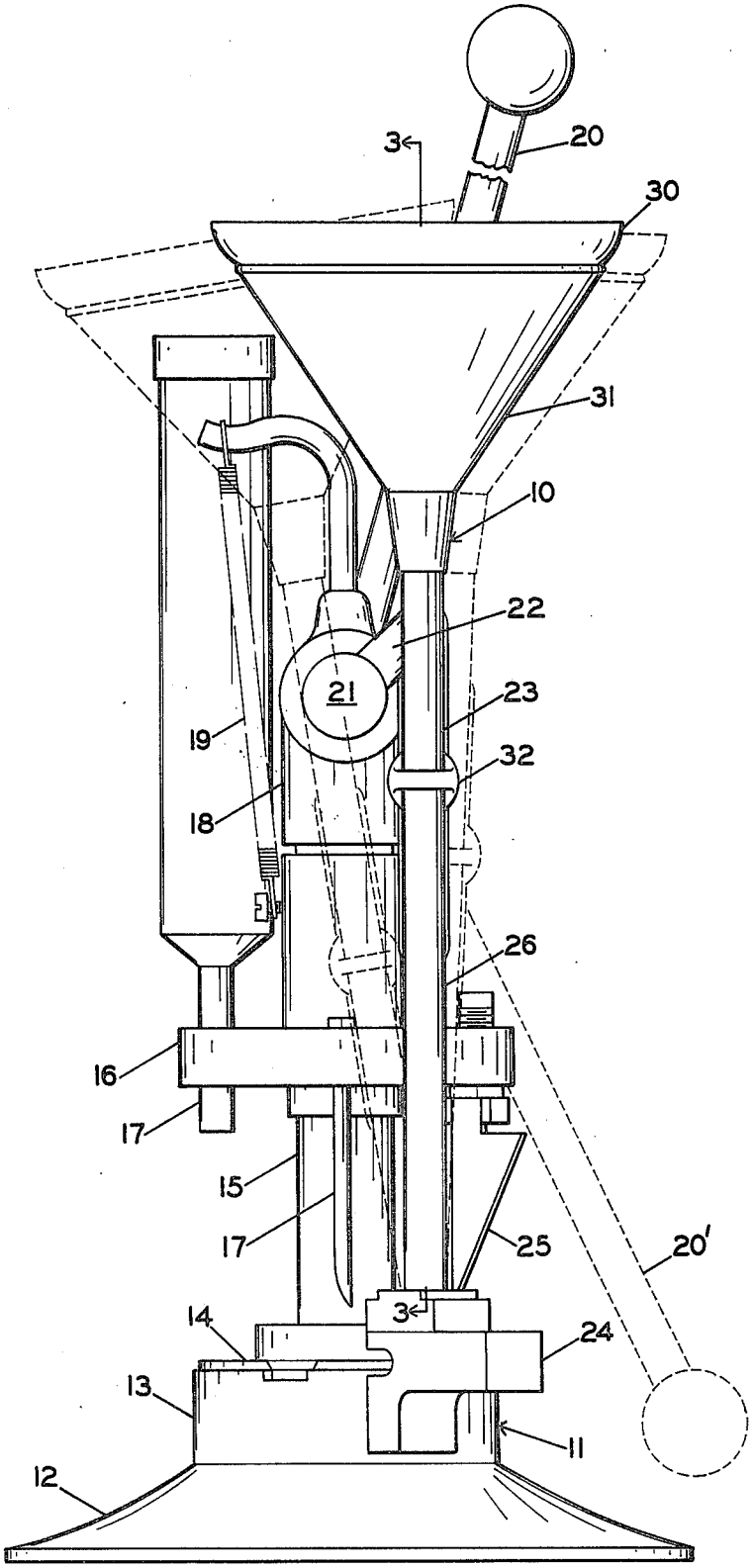
FIG. 1 is a front elevation view of my casing feeding device mounted on a shell reloader, with moved positions of the feeding device being shown in dashed lines for illustration.

Referring now more particularly to the drawings, wherein like numerals refer to like parts throughout the several views, a preferred embodiment of my casing feeder is shown generally at 10 in its operating position on a typical shell reloading machine 11. The shell reloading machine 11 is of standard construction, well known in the prior art as shown in the aforesaid U.S. Pat. No. 2,031,850, but its operation will be briefly described because my casing feeding device is especially adapted for use with this type of machine.

The shell reloading machine 11 includes a base 12, a shell loading table 13, and a shell registering plate 14 which is revolvably mounted to the table. A vertical post 15 is mounted to the table 13 and extends upwardly therefrom. A support member 16 is slidably mounted to the post 15 for up and down movement, and a plurality of shell unloading elements 17 are supported by the support member 16 in position to perform various functions on shell casings that are held in proper position on the table below. An end fitting 18 is attached to the top end of the post 15, and a spring 19 is attached between the end fitting and the support member to bias the support member upwardly towards the end fitting. An operating handle 20 is rotatably mounted to the end fitting 18 at a pivot 21, which is connected by a pair of rotating arms 22 and a pair of reciprocating links 23 to the support member 16. Rotation of the handle 20 downwardly by the operator transmits force through the arms 22 and links 23 to drive the support member 16 downwardly, while the support member is drawn back upwardly primarily by the restoring force of the spring 19. The downwardly rotated position of the handle 20 is shown in dashed lines labeled 20' in FIG. 1. During operation of the handle 20, the links 23 rock back and forth, as well as moving downwardly, as they drive the support member 16 to its downward position.

Also included on the shell reloading machine 11 is an automatically operated casing receiver and feeder 24, which is adapted to receive shell casings rim end downward and to transfer the casings one at a time to the table where they can be operated on by the various shell reloading tools. Each downward rotation of the handle 20 causes a plunger 25 to open the casing receiver to receive another casing. A vertical stack of aligned casings are delivered to the casing receiver 24 by a shell loading tube 26.

My casing feeding device 10 is adapted to feed casings into the shell loading tube such that the rim end of the casings are deposited downwardly without the necessity of manual alignment. The device includes a casing hopper 30 which is mounted to the top of the tube 26, a support cone 31 which is attached to the hopper to provide additional lateral support, and a tube support collar 32 which loosely surrounds the tube 23 to support the same in a generally upright position.

Figure 2:
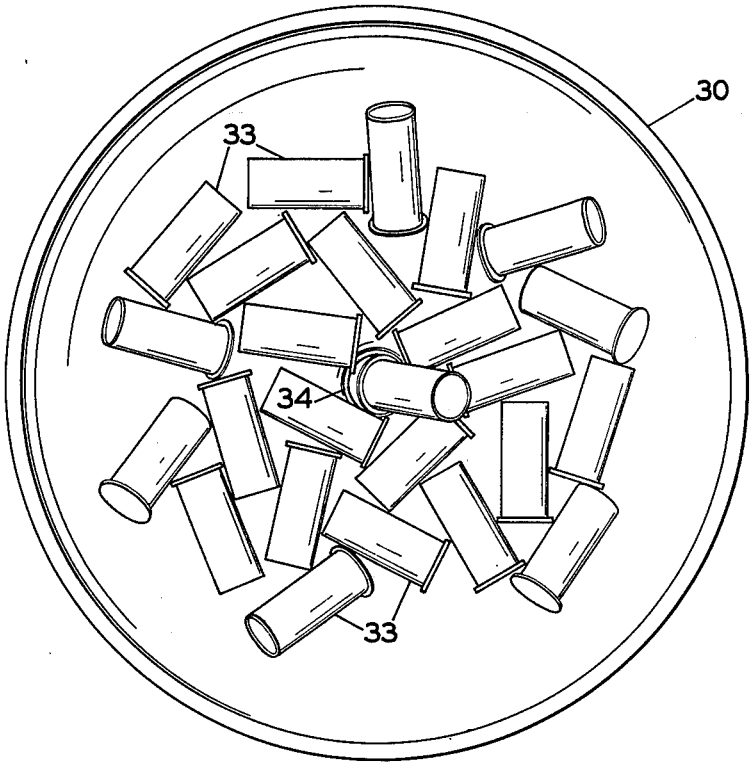
FIG. 2 is a top view of the hopper portion of the device of FIG. 1, shown with a plurality of randomly oriented casings therein for illustration.

In the top view of FIG. 2, a handful of shell casings 33 are shown deposited at random in the hopper 30. These casings migrate toward a central discharge opening 34 in the bottom of the hopper, and have a very strong tendency to fall by gravity into the opening with the rim end downward, as will be explained in further detail below.

Figure 3:
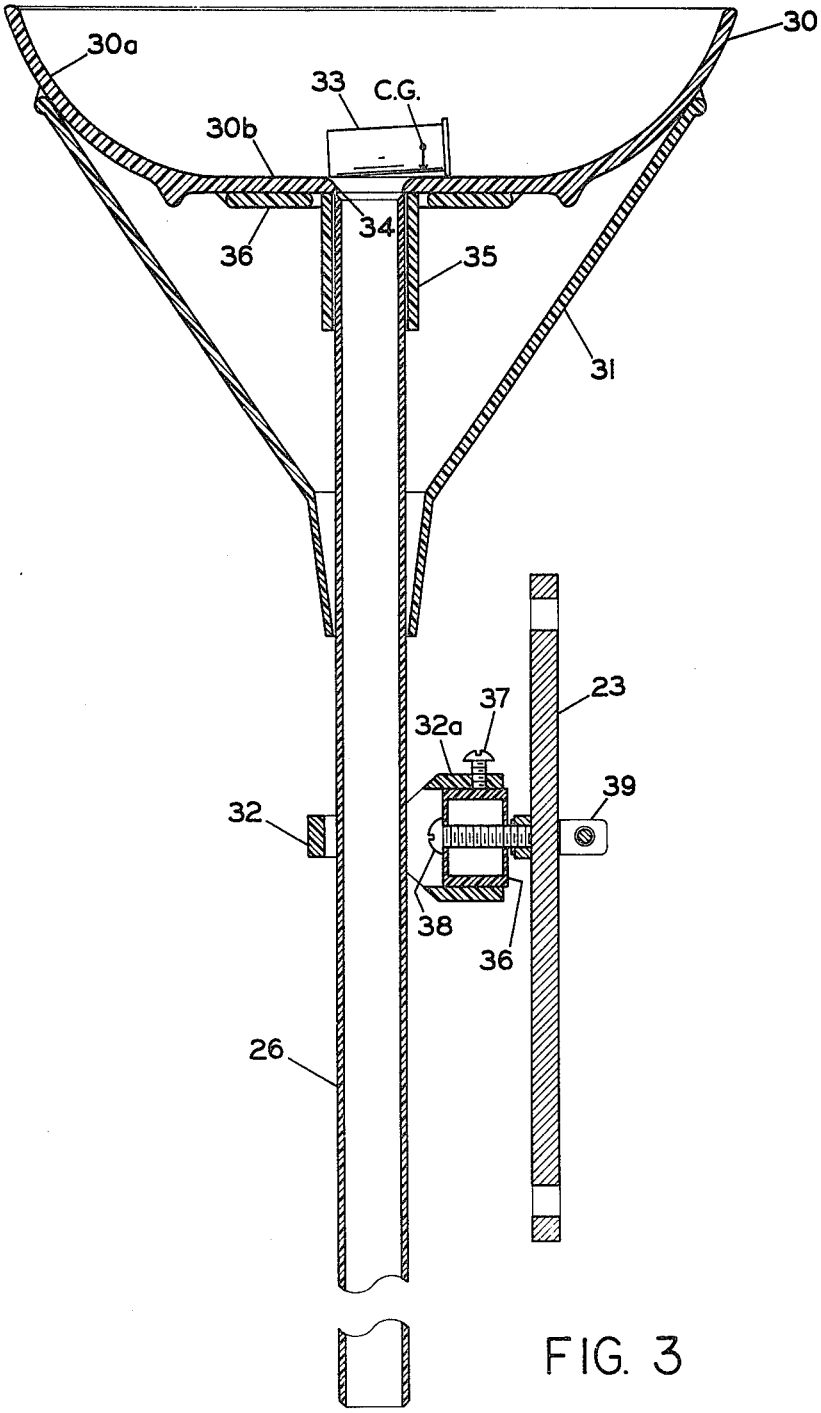
FIG. 3 is a cross sectional view of my casing feeding device taken along the line 3—3 of FIG. 1.

The details of the construction of my casing feeding device are best shown in the cross sectional view of FIG. 3. The casing hopper has curved sides **30*a* which lead to a substantially flat bottom portion 30*b*. The discharge opening 34 is preferably formed at a position substantially in the center of the flat bottom. Shell casings deposited within the hopper will tend to concentrate on the flat bottom portion, and upon agitation of the hopper, the casings will move about in the hopper such that the casings pass one by one over the opening 34** with a sufficient portion of the rim end extending out over the opening such that the casing will tip into the opening.

The standard construction of shell casings provides a large amount of material at the closed or rim end of the casing. Thus, the center of gravity of the casing is highly skewed toward the rim end. This situation is illustrated graphically in FIG. 3, in which the center of gravity of the casing 33 shown therein is indicated by a small downward arrow labeled C.G. The diameter of the opening 34 is selected to be larger than the diameter of the rim of the casing in order that the casing may freely fall through the opening. Generally, a discharge opening of this size is substantially larger than the distance from the closed or rim end of the casing to the center of gravity, but substantially smaller than the distance from the open end of the casing to the center of gravity. Thus, a casing can extend entirely across the opening without tipping when the open end of the casing is presented to the opening, as shown illustratively in FIG. 3. Satisfactory operation can be obtained with standard 0.38 and 0.45 hand gun shells wherein the diameter of the opening is approximately 2/10 of an inch larger than the rim diameter, such that the open end of the casing can extend across the opening without presenting the center of gravity to the opening.

The ability of my device to discriminate between the rim end and the open end of the casings is enchanced by providing a rounded edge on the opening 34 in the manner shown in FIG. 3. This rounded edge presents an opening of apparent larger diameter, which will tend to cause the rim end of the casing to slip more easily into the opening. However, the rounded edge provides virtually no additional tendency for the open end of the casing to slip into the opening. This holds true because the open end of the casing must rotate downwardly around a much longer radius than the closed end, and will always tend to be in contact with the edge of the opening 34 and will thus receive vertical support. In summary, casings that are presented open end first to the discharge opening will roll over the opening without dropping, while casings which approach the opening with the rim end first will drop into the opening once the rim is slightly over the edge of the opening.

The support cone 31 is preferably firmly adhered to the hopper 30 around its larger upper periphery and is thereby maintained in position. The hopper is mounted on the tube 26 by a tube support sleeve 35 which is adhered to the underside of the hopper beneath the discharge opening, with the inside bore of the support sleeve adapted to slidably and closely receive the tube. A weight ring 36 may be attached to the bottom of the hopper to provide additional weight to help maintain the device in position.

The casings within the hopper 30 are agitated back and forth to cause them to migrate toward the opening 34 by the action of the tube support collar 32, which is itself mounted to one of the reciprocating links 23. As shown in FIG. 3, the collar 32 includes a sleeve portion **32*a* which fits snuggly around a cylindrical mounting bushing 36. The collar 32 can thus rotate around a horizontal axis on the bushing 36 to allow the support collar to be aligned as desired to best support the loading tube in its proper upright position. The collar is also axially adjustable in and out on the bushing. A screw 37 may be provided to secure the collar 32 in a desired position on the bushing. The bushing itself is attached by means of a screw 38 and a mounting clamp 39 to the link 23**.

The action of the casing feeding device, as the operating handle 20 is manually operated, is best shown with reference to FIG. 1. The dashed lines shown in FIG. 1 are provided to illustrate the moved position of the tube and the casing hopper supported thereon. As the handle 20 is rotated downwardly, the tube and hopper first move inwardly toward the operator, and are then moved rearwardly as the operating handle is completely lowered to its position shown at 20'. This motion is caused by back and forth reciprocation of the link 23 which carries the tube support collar 32 along with it. The moved positions of the support collar are also shown in FIG. 1. It is apparent that the collar must only loosely hold the tube 32, since it is necessary that the collar move upwardly and downwardly on the tube and also rotate slightly with respect to the tube. The bottom of the tube rests in a socket (not shown) in the casing receiver 24 and can move freely about this support position.

It is understood that my invention is not confined to the particular construction and arrangement of parts herein illustrated and described, but embraces all such modified forms thereof that come with the scope of the following claims.

I claim:

1. A casing feeding device for feeding shell casings having a heavy end and adaptd for use with a shell reloading machine of the type including a manual operating handle, a link connected to the handle for reciprocation upon rotation of the handle, and a casing receiver for receiving shell casings rim end downward and transfering them into position for reloading, said casing feeding device comprising:

(a) an upright loading tube having an upper and a lower end, said tube being adapted to receive a column of casings and having its bottom end supported on the casing receiver of the shell reloading machine in position to deliver the column of casings therein to the casing receiver;

(b) a casing hopper mounted on the upper end of said loading tube and having upwardly extending sides and a substantially flat bottom, said bottom having a substantially circular discharge opening therein for receiving casings from said hopper and discharging them into said loading tube, the diameter of said discharge opening being greater than the distance from the rim end of the casing to be fed to the center of gravity thereof and less than the distance from the open end of the casing to its center of gravity, whereby casings will drop rim end first into said discharge opening without the need for moving parts in said hopper; and (c) a tube support collar loosely encircling said loading tube, said collar having mounting means for mounting said collar to the reciprocal link of the shell reloading machine to support said loading tube in an upright position on the casing receiver whereby when the handle of the shell reloading machine is manually operated, the resultant reciprocation of said link causes said tube support collar to rock said loading tube and casing hopper thereon providing migration of casings in said hopper randomly to said discharge opening into which casings drop rim end first because of the greater weight of the rim end.

2. The casing feeding device of claim 1 wherein said tube support collar is rotationally and axially adjustable on said mounting means.

3. The casing feeding device of claim 1 wherein the edge of the hopper bottom defining said discharge opening is beveled.

4. The casing feeding device of claim 1 including a mounting sleeve depending from the underside of said hopper around said discharge opening, said mounting sleeve telescoped over the upper end of said loading tube to releasably mount said hopper thereon.

5. The device of claim 1 including support means having a top end affixed to said hopper and a lower end receiving said loading tube therethrough to provide lateral support for said hopper on said tube.

* * * * *